US005956761A

United States Patent [19]

Capnerhurst

[11] Patent Number: 5,956,761

[45] Date of Patent: Sep. 28, 1999

[54] JACKET FOR USE IN HAIR COLOURING

[76] Inventor: Paulette Capnerhurst, 345 Mowat Cresent, Saskatoon, Canada

[21] Appl. No.: 08/963,241

[22] Filed: Nov. 3, 1997

[51] Int. Cl.[6] ..... A41D 27/12; A41D 27/16; A41B 13/10

[52] U.S. Cl. ..... 2/46; 2/50; 2/60

[58] Field of Search ..... 2/46, 48, 50, 108, 2/6, 468, 91, 98, 129, 135, 139, 141.2, 174, 206; 132/202, 208

[56] References Cited

U.S. PATENT DOCUMENTS

| | | |
|---|---|---|
| 969,491 | 9/1910 | Payne . |
| 2,282,183 | 5/1942 | Harris . |
| 2,686,914 | 8/1954 | Weiser . |
| 2,691,167 | 10/1954 | Oakvik . |
| 2,851,690 | 9/1958 | Jennings . |
| 2,973,523 | 3/1961 | Brainard et al. . |
| 3,161,887 | 12/1964 | Silver . |
| 3,514,788 | 6/1970 | Miller . |
| 4,258,438 | 3/1981 | Kirchner . |
| 4,709,420 | 12/1987 | Gettinger . |
| 4,919,081 | 4/1990 | Lewellen . |
| 5,586,339 | 12/1996 | Lathan . |
| 5,740,552 | 4/1998 | Smith . |

*Primary Examiner*—John J. Calvert
*Assistant Examiner*—Shirra Jenkins
*Attorney, Agent, or Firm*—A. D. Battison; Murray E. Thrift

[57] ABSTRACT

A jacket for use during hair coloring is described. The jacket is composed of two layers of plastic film and the jacket is disposable. The jacket comprises a body portion arranged to be fitted over the torso of an individual, two sleeve portions arranged to be fitted over the arms of the individual and a flared neck portion arranged to be rolled over and under the collar of the individual. It is of note that the jacket is arranged to fit loosely over the clothing of the individual for greater comfort. As a result of this arrangement, the above-described jacket protects the clothing and the neck region of the individual from damage by the chemicals used during the hair coloring process.

6 Claims, 1 Drawing Sheet

JACKET FOR USE IN HAIR COLOURING

BACKGROUND OF THE INVENTION

There are several devices known in the art that are intended to protect the clothing of an individual during the process of hair coloring. For example:

U.S. Pat. No. 2,016,079 discloses a disposable towel bib comprising a rectangular sheet with a neck opening and a slit leading from the neck opening to one side of the sheet. Furthermore, a tab at one side of the slit falls over as a locking tab in the neck. Thus, in this arrangement, the disposable towel bib is arranged to be fitted around the neck of the individual such that the disposable towel bib drapes over the clothing of the individual.

U.S. Pat. No. 2,093,483 teaches a protecting apron and towel. The apron is a rectangular sheet with a neck opening and a slit leading from the opening to one edge of the sheet. A collar band surrounds the neck and a towel is fastened to the collar band. Thus, this device is essentially a sheet arranged to be draped over the clothing of the individual that includes attachment means located on the neck opening for attaching a towel to the sheet such that the towel depends downward from the neck.

U.S. Pat. No. 2,769,980 teaches a hair drying shield comprising a sheet with a concave neck opening at the centre and pockets on opposite sides of the neck opening for suspending the shield from the ears of the individual. Thus, this device is arranged to be fitted over the head of the individual such that the sheet drapes downward therefrom.

U.S. Pat. No. 3,031,676 teaches a disposable cape for beauty salon patrons comprising a thin plastic sheet attached to a reusable neck band. Thus, in this arrangement, the sheet depends downward from the collar so as to drape over the clothing of the individual.

U.S. Pat. No. 4,458,364 teaches a disposable towel arranged to be fitted around the collar of the individual much like a bib. Thus, in this arrangement, the disposable towel depends downward from the collar of the individual.

U.S. Pat. No. 4,914,754 teaches a disposable cap and cape comprising a cap pocket at one end arranged to be fitted over the individual's head as a cap and a U-shaped neck cut out at the other end. Thus, in this arrangement, the cape is arranged to depend downward from the head of the individual.

Obviously, the devices described above do not provide sufficient protection to the clothing of an individual during the process of hair coloring. Specifically, all of the above listed devices are arranged to be draped over the clothing of the individual or arranged to depend downward from the neck of the individual. As a result of this arrangement, there is considerable risk that the protective device will become twisted or shift unexpectedly, thereby exposing the clothing of the individual to the chemicals used in the hair coloring process which may stain or otherwise damage the clothing of the individual. Furthermore, none of these devices offer adequate protection to the neck and collar region of the individual, which is the region most likely to be in direct contact with the hair during the coloring process. In addition, many of these devices are costly to manufacture. Clearly, a device is needed that overcomes the limitations of the prior art.

SUMMARY OF THE INVENTION

It is an object of the present invention, therefore, to provide a jacket for use in hair coloring.

According to one aspect of the invention there is provided a jacket for use in protecting clothing during hair coloring, said jacket comprising two superimposed layers of plastic film, shaped to provide:

a body portion;

two sleeve portions at the top of the body portion and projecting in opposite directions;

a neck flaring upwardly from between the sleeve portions, the layers being joined along opposite sides of the body portion and along top sides of the sleeve portions, and being unconnected along a bottom of the body portion, ends of the sleeve portions and a top of the neck.

One of the layers may be separated into two parts along a line extending from the top of the neck to the bottom of the body portion. As a result of this arrangement, the jacket is open along one side.

The sleeve portions may be elbow-length.

The layers of plastic film may be composed of recycled plastic

As is apparent from the above description, the above-described jacket is inexpensive to manufacture and therefore may be disposable.

Similarly, according to another aspect of the invention, the above-described may be included in a hair coloring kit.

Thus, the above-described jacket is arranged to be fitted over the clothing of an individual. Specifically, the body portion is fitted over the torso of the individual and the two sleeve portions are fitted over the arms of the individual. In addition, the neck portion is rolled over the collar and under the collar of the individual, thereby providing protection to the neck and the collar region of the individual. Furthermore, as the jacket is fitted over the arms and torso of the individual, the jacket will not twist or shift during the coloring process as would a draped sheet, thereby providing maximum protection to the clothing of the individual. In addition, the above-described jacket is inexpensive to manufacture and therefore may be included in a hair coloring kit or used as a disposable item.

One embodiment of the invention will now be described in conjunction with the accompanying drawings in which:

DETAILED DESCRIPTION

Figure 1:
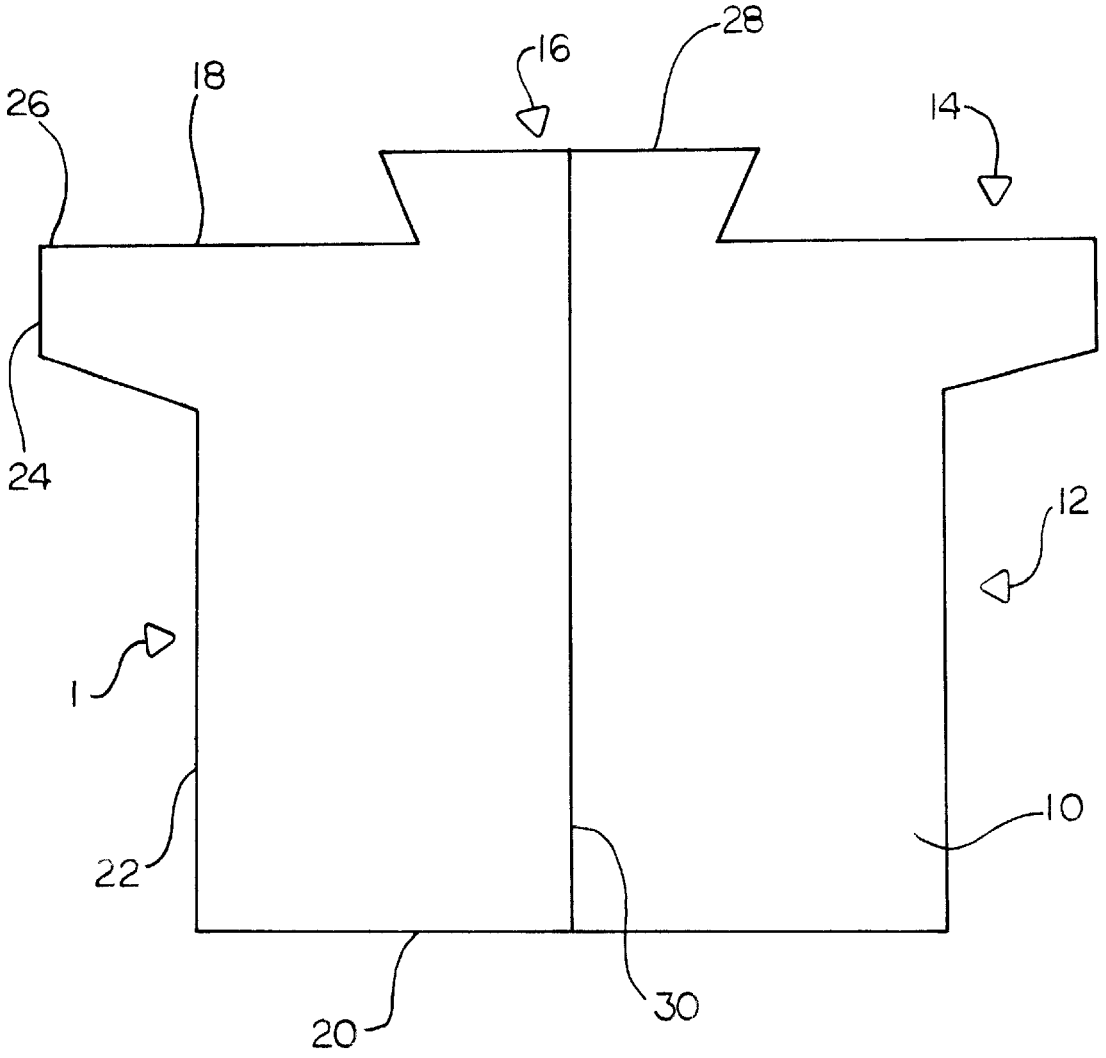
FIG. 1 is a front view of the jacket.

Referring to the drawing, a jacket 1 for use during hair coloring comprises two superimposed layers of plastic film 10 shaped to provide a body portion 12, two sleeve portions 14 and a neck 16.

The body portion 12 comprises a top 18, a bottom 20 and two sides 22 and the body portion 12 is arranged to be fitted over the torso of an individual as described below.

The two sleeve portions 14 project in opposite directions from the sides 22 of the body portion 12 proximal to the top 18 of the body portion 12 as shown in FIG. 1. Furthermore, the two sleeve portions 14 are arranged to include ends 24 and top sides 26 and the two sleeve portions 14 are arranged to be fitted over the arms of an individual as described below. In this embodiment, the two sleeve portions 14 are arranged to be approximately elbow length. As a result of this arrangement, the forearms and hands of the individual are not encumbered while wearing the jacket, thereby facilitating the hair coloring process as described below.

The neck 16 flares upwardly from between the two sleeve portions 14 at the top 18 of the body portion 12, terminating at a distal end 28. In this embodiment, the neck 16 has a substantially conical shape, the neck 16 being tapered proximal to the body portion 12 as shown in FIG. 1. It is of note that the neck 16 is arranged to be somewhat elongated for rolling under the clothing of an individual as described below.

The jacket 1 is assembled by joining the two layers of plastic film 10 along the sides 22 of the body portion 12 and along the top sides 26 of the two sleeve portions 14. Of note is that the two layers of plastic film 10 are unconnected along the bottom 20 of the body portion 12, the ends 24 of the sleeve portions 14 and the distal end 28 of the neck 16. Furthermore, the two sleeve portions 14 are elongated or over-sized so that the jacket may be used by individuals of stature. In this embodiment, one of the two layers of plastic film 10 is separated into two parts along a line extending from the distal end 28 of the neck 16 to the bottom 20 of the body portion 12. As a result of this arrangement, the jacket 1 includes an opening 30 for fitting the jacket 1 over the clothing of an individual as described below.

In operation, the individual places the jacket 1 over top of their clothing. Specifically, the body portion 12 is fitted over the torso of the individual and the sleeve portions 14 are fitted over the arms of the individual. It is of note that the jacket 1 is arranged to be loose-fitting over the clothing of the individual for greater comfort. In addition, as noted above, the two sleeve portions 14 are elongated or over-sized for fitting the jacket 1 over the arms of individuals of stature. The neck 16 is then rolled over and under the collar of the individual so as to protect the neck and collar region from the chemicals used during the hair coloring process. As the clothing and neck area of the individual are protected by the jacket 1, treatment of the hair of the individual with the appropriate chemicals for coloring the hair can now begin. As noted above, in this embodiment, the two sleeve portions 14 are elbow length. As a result of this arrangement, the hands and forearms of the individual are unencumbered during the hair coloring process.

As the above-described jacket 1 is arranged to be fitted over the clothing of the individual and not simply draped over the clothing of the individual, the risk that the jacket 1 will become twisted or shift unexpectedly and expose the clothing of the individual to the chemicals used during the hair coloring process is minimal.

The two layers of plastic film 10 may be composed of recycled plastic.

As noted above, the above-described jacket 1 is inexpensive to manufacture and therefore may be disposable if desired. Furthermore, the above-described jacket 1 may be included in a kit containing the chemicals and solutions necessary for hair coloring.

Since various modifications can be made in my invention as herein above described, and many apparently widely different embodiments of same made within the spirit and scope of the claims without department from such spirit and scope, it is intended that all matter contained in the accompanying specification shall be interpreted as illustrative only and not in a limiting sense.

I claim:

1. A jacket for use in protecting clothing during hair coloring, said jacket comprising two superimposed layers of plastic film, shaped to provide:

a body portion;

two sleeve portions at the top of the body portion and projecting in opposite directions;

an elongated neck flaring upwardly from between the sleeve portions, said neck having a substantially conical shape wherein the neck has a narrow end attached to the body portion, said neck being arranged so as to roll over and under a collar to provide protection to the neck and collar region of an individual, the layers being joined along opposite sides of the body portion and along top sides of the sleeve portions, and being unconnected along a bottom of the body portion, ends of the sleeve portions and a top of the neck.

2. The jacket according to claim 1 wherein one of the layers is separated into two parts along a line extending from the top of the neck to the bottom of the body portion.

3. The jacket according to claim 1 wherein the sleeve portions are elbow-length.

4. The jacket according to claim 1 wherein the jacket is disposable.

5. The jacket according to claim 1 wherein the layers of plastic film are composed of recycled plastic.

6. A hair coloring kit including the jacket according to claim 1.

* * * * *